United States Patent [19]

Finelt

[11] Patent Number: 4,777,996

[45] Date of Patent: Oct. 18, 1988

[54] SELF-SEALING PLASTIC BASE AND A CYLINDRICAL FLASK FOR LOST WAX PROCESS

[76] Inventor: Howard I. Finelt, 7 Tor Ter., New City, N.Y. 10956

[21] Appl. No.: 534,597

[22] Filed: Sep. 22, 1983

Related U.S. Application Data

[63] Continuation-in-part of Ser. No. 461,272, Jan. 26, 1983, abandoned, which is a continuation of Ser. No. 874,113, Feb. 1, 1978, abandoned.

[51] Int. Cl.[4] ..... B22C 7/02; B22C 9/04; B22C 21/00

[52] U.S. Cl. ..... 164/237; 164/244; 164/376; 249/54; 249/62

[58] Field of Search ..... 164/237, 244, 249, DIG. 4, 164/376; 220/306, 309, 352, 355; 249/54, 62

[56] References Cited

U.S. PATENT DOCUMENTS

| | | | |
|---|---|---|---|
| 2,487,400 | 11/1949 | Tupper | 220/306 X |
| 3,065,875 | 11/1962 | Negoro | 220/306 |
| 3,387,765 | 6/1968 | Davis | 220/306 X |
| 3,610,317 | 10/1971 | Benfield et al. | 164/238 |
| 4,081,019 | 3/1978 | Kulig | 164/244 X |

*Primary Examiner*—Nicholas P. Godici
*Assistant Examiner*—J. Reed Batten, Jr.
*Attorney, Agent, or Firm*—Peter L. Berger

[57] ABSTRACT

A plastic base for use with a cylindrical flask for the elimination of wax patterns prepared for making metal castings by the lost wax process is identified. The base is made of a plastic material which is used in place of conventionally found rubber bases. The base is constructed of a thin-walled resilient plastic material and allows for direct set up of the wax patterns, as well as increased speed in the preparation of the plaster mold in the cylinder for making metal castings. The plastic base comprises an inner annular raised platform comprising a shoulder and the cylindrical flask is pressed on the shoulder deforming the plastic about the bottom edge of the flask to form a seal between the base and flask.

12 Claims, 2 Drawing Sheets

SELF-SEALING PLASTIC BASE AND A CYLINDRICAL FLASK FOR LOST WAX PROCESS

This is a continuation-in-part of application Ser. No. 461,272, filed Jan. 26, 1983, which itself is a continuation of application Ser. No. 874,113, filed Feb. 1, 1978, and both now abandoned.

BACKGROUND OF THE INVENTION

This invention relates to bases for use with cylindrical flasks utilized in making metal castings by the lost wax process, and more particularly, to a replacement base which eliminates many of the problems attendant present bases.

PRIOR ART STATEMENT

A novelty search was conducted and the most relevant prior reference found was a patent to James W. Benfield et al. entitled Crucible Former, U.S. Pat. No. 3,610,317.

The Benfield et al. patent discloses a plastic replacement for the conventional rubber crucible former for use in the production of metal castings by the lost wax process. The crucible former is disclosed as being made of plastic and is disposable. In particular, referring to the figures, there is shown the plastic crucible former 2 to which a sprue pin 5 is attached by its being secured to a hole in the crucible former. There is also shown, as part of the investment forming process, the use of a base 4 which has a flat bottom surface.

The present invention is distinguished from the Benfield et al. patent in that the present invention is concerned with replacing the base 4 with a plastic member, and not with replacing the crucible former with the plastic construction 2 as shown in the Benfied et al. patent. As will become more clear hereinafter, the important structural differences between the present, invention and the plastic crucible former in the Benfield et al. patent allow for increased speed in terms of the casting process, elimination of difficult and time consuming clean up processes, elimination of wear and tear to the rubber bases presently used, efficiency in the set up of sprues to the base, minimization of the use of wax as a base soldering material for the sprues, effective sealing between the base and flask and other advantages.

BACKGROUND OF THE INVENTION

As briefly described above, the present invention is directed to replace the present rubber bases used in the industrial casting processes employing the "lost wax" process. The present rubber base is provided with an exterior rim used to hold the cylinder in place while "investment" such as plaster of paris, is poured around a wax pattern which is held in place by a sprue attached to wax which is housed within the rubber base. The sprue is attached to the wax material held in the rubber base by means of heat, so that the wax pattern which is attached to the sprue is fixed in place as the investment material is poured in the cylinder or flask.

The next step in the casting process requires the removal of the wax patterns, and this is done by heating the formed cylindrical plaster of paris block. Clearly, this cannot take place until the rubber base is removed, and the rubber base cannot be removed until the investment material dries. Consequently, significant time is wasted while the investment material is drying before the block can be placed in an oven to remove and melt out the wax material.

It is important that the cylinder or flask be tightly connected to the base, and for that purpose, conventionally wax is used to fill in interstices around the outer edge of the lower portion of the cylinder. Further, the conventional rubber base is adapted to hold a significant amount of wax to which the sprues may be directly set up. Such a significant amount of wax presents problems in the later burning out of the wax in the oven, because of the environmental considerations of burning large amounts as created by the wax block reservoir.

As part of the process in which investment is poured around the wax pattern in the flask, a vacuum is applied so as to compact and remove air pockets in the investment material. As a consequence, the rubber base which has a flat bottom strongly adheres to the table upon which it sits, and with the weight of the investment material on top of the rubber base, it becomes very difficult to remove the rubber base from the support table. A period of minutes as well as a releasing procedure is necessary to remove the rubber base from the rubber mat of the vacuum table. Because the investment (plaster of paris) is still liquid, at this time, a waiting period of at least 5 to 8 minutes is necessary before the flask can be removed from the table.

Further, the cylinder is often knocked about and this causes minor surface irregularities in the liquid plaster.

Further, the removal of the rubber base from the cylinder is time consuming and extremely difficult to remove because of the plaster adhering to the rubber and wax surfaces. The removal process also creates movement of the wax patterns and the set-up areas causing crevices which create improper metal flow into the pattern after burn out.

A sharp blade must be used to pry the rubber from the supporting platform and the rubber base suffers significant wear and tear causing surface irregularities to be formed.

The rubber base is not adaptable to conform to these different surface irregularities, and this eliminates some of the important air tight properties required during the investment process.

One of the significant disadvantages of the rubber base is that the wax (interior reservoir) which is contained therein sticks to the rubber, as well as does some of the investment material. As a consequence, the rubber bases which are used and reused have to be cleaned between uses. The tixe required to clean these bases is significant, and the labor costs are such that the costs for cleaning such rubber bases become expensive. The reservoir must be refilled with wax and all walls must be completely cleaned with a knife or sharp instrument.

When the rubber base is eventually removed, it often has a rough surface due to its continual reuse and cleaning. As a consequence, the flow of metal into the pattern formed by the lost wax process becomes impaired by the crevices and can cause turbulence in the material flow to the pattern. The minimization of friction as well as the improvement of surfaces allowing for the metal to pass into the patterns is an important objective.

As presently constituted, separate base forms are required for different type of cylinders because of different interior designs. This often results in confusion and lost time and presents significant problems in the industry.

An important problem found in the prior art is that the information relating to the cylinder number, temperature and related data contained therein and to be placed threin is often written on the plaster top of the cylinder with a special crayon. This information is often burned off in the oven, or is unclean and this causes significant lost material and time. Further, records of each cylinder and the materials placed therein are required. These records are on paper, and are burned up during the wax elimination, so that the information identifying the cylinder number, the interior pattern and/or the product becomes unavailable.

An object of this invention is to eliminate the above-mentioned disadvantages and to provide a base for use with a cylindrical flask in the lost wax process which is inexpensive, simple to use, disposable, and will meet with significant commercial success.

SUMMARY OF THE INVENTION

In accordance with the principles of this invention, the above objects are accomplished by providing the combination a plastic base and a cylindrical flask, the base being circular and having an outer annular raised rim terminating inwardly in a concentric channel, an inner concentric raised platform integrally formed in the base terminating in the channel on one side, the platform forming the bottom for the flask during the time the investment is poured into the flask, a raised concentric central support terminating at its exterior in the raised platform, the raised concentric central support being elevated above the raised platform, and having reservoir areas to receive wax to which sprues can be secured, the platform being wider than the cylinder so as to form a tight-fit when the cylinder is pressed downwardly on the platform deforming the plastic base to seal the base and flask

DETAILED DESCRIPTION

Figure 1:
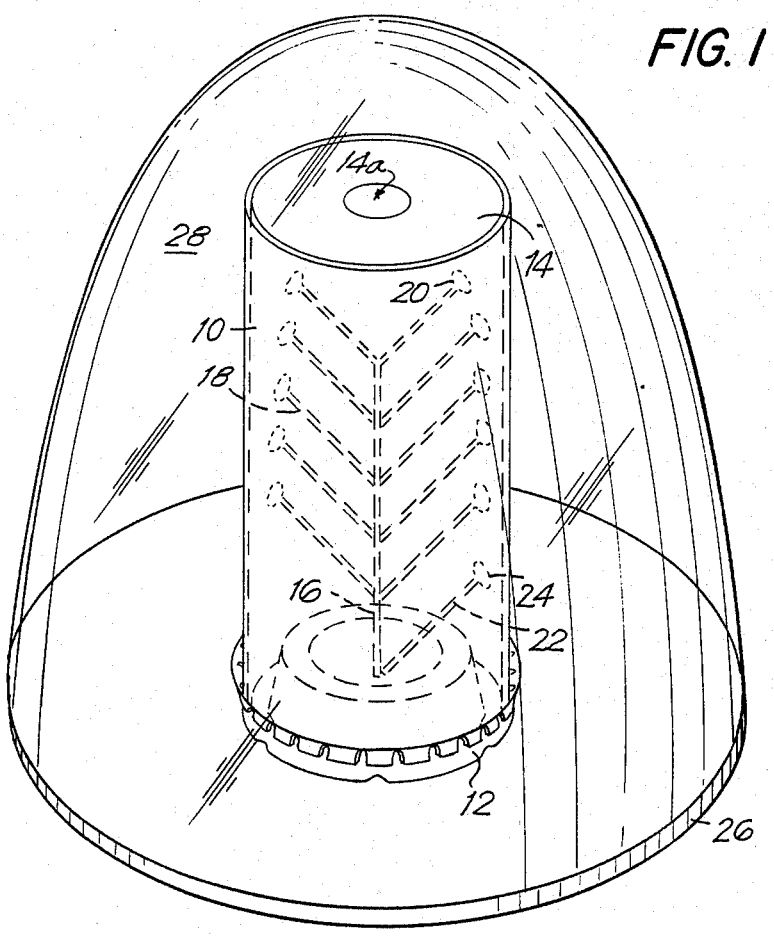
FIG. 1 is a perspective view of the cylindrical flask and base housed within a bell jar as part of the process for forming the impressions within the investment.

Referring now to the drawings, there is shown in FIG. 1 a cylinder or flask 10 resting on a base 12, the entire assembly having investment 14 poured therein, the investment forming around a sprue 16 to which are attached additional sprues 18, the sprues 18 terminating in wax pattern forms 20. The wax forms are impressions of the eventual metal casting to be made, there is also shown an additional sprue 22 directly set to the base 12 to which is attached a single wax form 24. In operation, the center sprue 16 as well as additional sprues, such as 22, are secured to the base 12, in a manner to be described hereinafter, and investment 14 is poured within the cylinder or flask 10. The vacuum is applied with the base 12 resting on a work table 26 in order to firmly compact and remove air pockets in the investment within the flask 10.

With the prior art, the base was formed of rubber, and prior to removing the rubber base from the flask, it was required that the investment dry. As can be seen this would require some period of time, so that time is wasted.

The process following that shown in FIG. 1 is for the block formed of flask 10 with the investment material therein to be placed in an oven with the wax patterns being melted out so that the "lost wax" process occurs. Thereafter, molten metal is flowed into the open patterns formed by the lost wax being melted out, and the metal forms are cast.

As may be seen from FIG. 1, in the prior art the rubber base was flat and when the vacuum was formed in bell jar 28, the rubber base created a suction cup and adhered to the platform thus requiring a knife edge to release the suction and remove the rubber base from the work table. This caused significant damage to the rubber base on a regular basis and is very time consuming and delicate to remove.

As may be further seen, the prior rubber base would have a significant wax reservoir portion thereof holding wax to which the sprues 16 and 22 could be attached. This wax core was excessive but necessary in the prior art to be held in place during the vacuum procedure and therefore, this wax had to be burned out in the oven. Consequently, the burn out of excessive wax causes environmental problems.

As may be seen in FIG. 1, the cylinder contains specific patterns and is to be filled with specific materials. This previously had been separately recorded on a sheet of paper, and in some cases, the information concerning the material in the cylinder was etched on the plaster top of the cylinder. In the oven, the writing on the cylinder often would burn out or would become difficult to read. Further area **14*a*** for the pertinent data required was too small and often caused confusion because of the amount of writing on the plaster top.

It is important that the cylinder 10 fixedly and securely be attached to the base 12 to eliminate problems during the plaster pouring and evacuation process. This was often done by adding additional wax to seal the outer edges of the base to the lower portion of the cylinder, which additional wax also caused. problems for clean up as well as being additionally time consuming.

Figure 2:
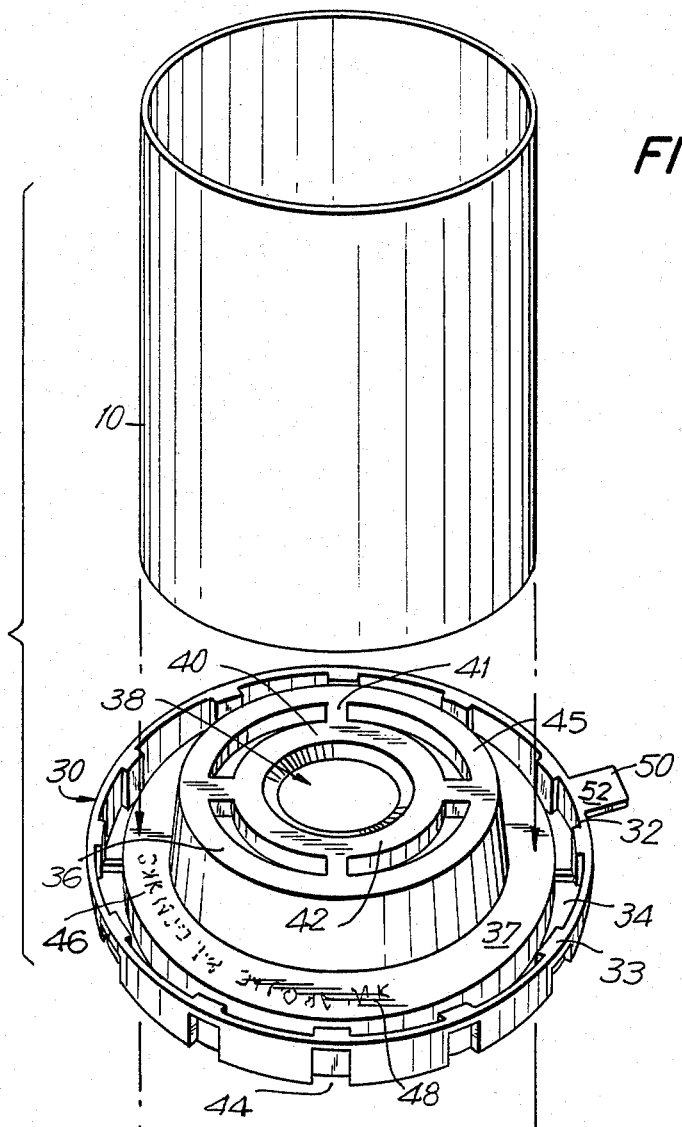
FIG. 2 is a perspective view of the flask being moved into the platform of the base.
Figure 3:
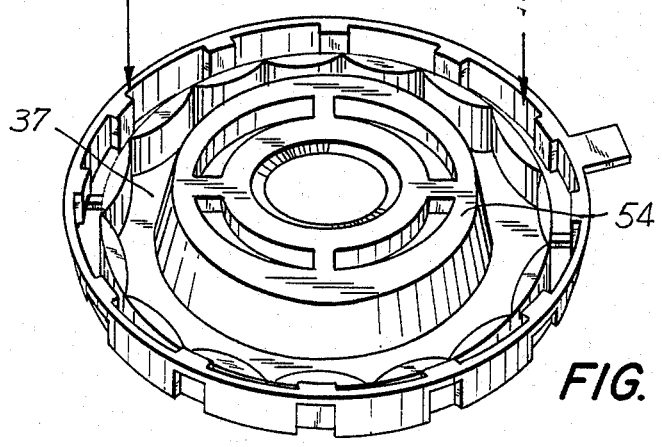
FIG. 3 is a perspective view of the base after being deformed as shown in FIG. 2.

Referring to FIGS. 2 and 3, there is shown my invention in which a plastic base is illustrated, the plastic base being generally designated by the numeral 30. The plastic base has a generally outer raised rim 32 formed with supporting ribs 33 which are in the form of stiffening members integrally formed therewith, the stiffening members comprising vertically oriented members and ridges radially spaced on the rim. The outer raised rim 32 terminates in a concentric channel 34. The channel terminates inwardly in an inner concentric platform 36 which itself terminates in a raised concentric central support region 38 formed of a hub 40, radial ribs 41 and annular rings 42 and 45. Platform 36 forms the bottom for the cylinder when placed on the base, and it is this bottom which supports the investment material poured therein. The raised concentric central support comprises a wax carrying region. If only light or smaller parts are attached to sprues which are attached to the central support region 38, then no wax may be required in the wax carrying regions, since the plastic material itself is deformable upon the application of heat, and the sprue can be directly attached to the base.

There are also provided air passages 44 along the lower edge of the base so that as the base rests on the work table in the bell jar 28 of FIG. 1, air can pass beneath the base thereby enabling the base and cylinder to self-release from the platform 26. This will eliminate the need for actually physically separating the base from the platform.

The raised platform 36 comprises an annular shoulder 37, and the diameter of flask 10 is smaller than that of shoulder 37. When the flask is pushed down on shoulder 37, the thin-walled plastic base deforms about the bottom edge of the flask to seal the flask and base. The diameter of the flask is at least one-eighth inch smaller than that of the shoulder so that sufficient material is available to form the seal. The plastic base material itself is of suitable type and thickness to be able to be deformed without breaking. The outer rim 32 now serves to catch the overflow during the vacuum procedure. This invention provides an effective sealing arrangement which was unattainable in prior art plastic base constructions for cylindrical flasks.

As another feature of this invention, there is shown in FIG. 2 the placement of embossable identifying indicia 46 and 48 which can be used to identify the cylinder size and the type of product to be placed in the molds, respectively. Since the base is made of a plastic material, such identifying indicia 46 and 48 can be embossed thereon and actually be formed within the investment material as it dries and hardens. This eliminates the possibility of lost information concerning the size of the cylinder and the material to be placed in the open forms within the block. Further, a tab member 50 is integrally formed with the base and is detachable therefrom, the tab member carrying the identifying indicia for the identical cylinder, for instance shown to be 52, and the tab will also be able to receive information concerning the temperature and amount of material required to be placed within the cylinder. These tabs are separately stored so as to have easy access in increasing the efficiency of the testing process employed herein. In addition, the tab is pressed into area **14*a* (FIG. 1**) such that the information embossed thereon is impressed in that area.

In operation, the plastic base is retained with the cylinder and the entire assembly is paaced within the oven. The plastic base will melt and disintegrate and be carried off as is the wax which was located within the investment. Therefore, the lost time required for the investment to dry prior to removing the rubber base has been eliminated. Further, the use of the rubber base has been eliminated as well as its significant attendant disadvantages listed above. One of the important disadvantages was that the rubber base developed surface irregularities which impeded the flow of molten metal into the mold when the casting process was to occur. Such surface irregularities would primarily be contained along the bottom of the reservoir, and by using a thin-plastic material, the bottom edge 54 of the base is flat and smooth and thus providing a smooth and glass-like surface minimizing friction and increasing the flow of metal into the pattern.

As another feature of this invention, the plastic bases may be color coded to further differentiate between base sizes, styles and shapes.

The use of thin-plastic material as well as the larger shoulder 37 allows for contour irregularities in the cylinder or flask to be accommodated without impairing the seal between the base and flask.

It should be further understood that the disposable plastic set up base serves as a self-sealing device since the shoulder 37 securely seals the flask 10. During the evacuation process the newly formed seal of the base prevents the plastic base from being drawn upwardly through the bottom of the flask and is further sealed against the bottom edge of flask 10. This raised rim also catches the liquid plaster in the base when the liquid paster of paris is initially poured into the flask.

In one embodiment, the plastic base is formed of polystyrene having a wall thickness between 0.010 and 0.015. The material can be any plastic with a rigid form with a melting point no greater than 400° F.

Figure 4:
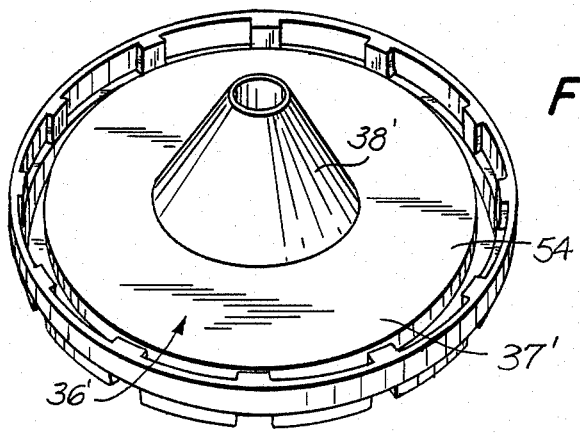
FIG. 4 is another embodiment of a base construction.

FIG. 4 shows another embodiment of this invention in which platform 36' and shoulder 37' are larger in size than that of FIG. 2. Additionally, the central support 38' is a raised cone more similar to the prior art rubber base.

Although the present invention is illustrated with a cylindrical flask, any shape for a flask is suitable, so long as the base conforms to the circumferential shape of the flask. It should be understood that the plastic base will burn out since its melting temperature will be less than the melting temperature of the patterns enclosed in the plaster.

The above objects have been accomplished with the invention described above. It is understood that the above description only illustrates an embodiment of the present invention, and that other embodiments are obtainable by those of ordinary skill in the art.

What is claimed is:

1. A combinatin of a set-up base and a flask for wax patterns prepared for making metal castings by a casting process in which investment material is poured into said flask after said base is in place, said base comprising an outer raised rim terminating inwardly in a channel, said channel terminating inwardly at a raised platform, said raised platform forming the bottom for the flask during the time the investment material is poured into said flask, said raised platform having a shoulder extending inwardly and terminating at a raised central support, said raised central support comprising a reservoir adapted to hold set-up material to which a sprue may be secured, said base being formed of a thin-walled resilient plastic material and comprising a thickness such that said base is melted and carried off during said casting process, said base resting on a work table, said flask being smaller in cross-section than said base, said flask being smaller than the outer dimensions of said shoulder such that said flask rests on said shouder with an annular portion of said shoulder extending beyond the periphery of said flask, said thin-walled plastic material being deformed and sealing said flask as said flask is pressed downwardly on said shoulder.

2. The combination as claimed in claim 1, wherein said flask is cylindrical and said base is circular, said shoulder comprising an annular surface having a diameter larger than the diameter of said cylindrical flask.

3. The combination as claimed in claim 1, wherein said reservoir comprises a central depressed region forming an inner reservoir encircled by an annular outer reservoir, with set-up material capable of being stored in said inner and outer reservoirs.

4. The combination as claimed in claim 1, wherein said base comprises air escapement passages integrally formed with the bottom edge of said base, said air escapement passages maintaining an air flow path underneath the base when said flask is placed on said base.

5. The combination as claimed in claim 1, wherein said resilient plastic material comprises embossable plastic, said embossable plastic having characters embossed thereon, said characters forming corresponding impressions in said investment material.

6. The combination as claimed in claim 1, wherein sprues are utilized and said plastic material of said base is deformable, said sprues being directly set up to said plastic base with the application of heat to said plastic base.

7. The combination as claimed in claim 1, wherein said base further comprises a removable side tab member integrally formed with said base and separable therefrom, said tab being adapted to carrying identifying indicia corresponding to the casting process.

8. The combination as claimed in claim 1, wherein said base comprises color coding means to identify different base specifications.

9. The combination as claimed in claim 2, wherein the diameter of said shoulder is at least $\frac{1}{8}''$ greater than the diameter of said flask.

10. The combination as claimed in claim 2, wherein said plastic base comprises polystyrene.

11. The combination as claimed in claim 10, wherein said plastic base is at least 0.010 inches thick.

12. The combination as claimed in claim 1, wherein said outer rim comprises a catchment area collecting spilloff material generated in the casting process.

* * * * *